United States Patent [19]

Nishizawa

[11] 3,939,604

[45] Feb. 24, 1976

[54] EXCHANGEABLE-DRESSING DOLL

[76] Inventor: Shinhachiro Nishizawa, 1-279, Okuyama, Ashiya, Hyogo, Japan

[22] Filed: Nov. 4, 1974

[21] Appl. No.: 520,657

[30] Foreign Application Priority Data

| | | |
|---|---|---|
| Aug. 20, 1974 | Japan | 49-99787[U] |
| Aug. 23, 1974 | Japan | 49-101669[U] |
| Aug. 20, 1974 | Japan | 49-95651 |
| Aug. 23, 1974 | Japan | 49-97324 |

[52] U.S. Cl. ..... 46/151; 46/157; 46/162

[51] Int. Cl.[2] ..... A63H 03/04

[58] Field of Search ..... 46/151, 157, 158, 162

[56] References Cited

UNITED STATES PATENTS

| | | | |
|---|---|---|---|
| 3,624,691 | 11/1971 | Robson | 46/151 |
| 3,855,730 | 12/1974 | Baer | 46/158 |

FOREIGN PATENTS OR APPLICATIONS

| | | | |
|---|---|---|---|
| 1,169,501 | 9/1958 | France | 46/151 |
| 534,933 | 3/1941 | United Kingdom | 46/162 |

*Primary Examiner*—Louis G. Mancene
*Assistant Examiner*—Robert F. Cutting
*Attorney, Agent, or Firm*—Stevens, Davis, Miller & Mosher

[57] ABSTRACT

The exchangeable-dressing doll comprising an exchangeable-dressing doll body having some degree of stereoscopic appearance and reality which is soft and smooth to the touch and usable safely as a toy for young children, and exchangeable parts therefor which are freely detachable including clothes, shoes, gloves, wigs and the like. The doll has a freedom to flex at optional parts of the body such as parts corresponding to the articulations of the limb, trunk, neck or the like, and at least the limb can be caused to take any simulated forms fitting to various actions of the body found in the daily life.

8 Claims, 11 Drawing Figures

EXCHANGEABLE-DRESSING DOLL

BRIEF DESCRIPTION OF INVENTION

The present invention is related to a doll body made of synthetic resin and to exchangeable parts therefor attached thereto which is freely detachable, including clothes, shoes, gloves, hats, wigs and the like, to be used by girls in their dress exchanging play.

Conventionally, there have been the said type of dolls made of cardboard for the dress exchanging play from of old and, currently, dolls molded to the shape of human body has been provided by using soft synthetic rubber. However, since the former type of doll is apt to be turned down and broken easily, it is impossible to cause the doll to take optional attitudes, in spite of its inexpensiveness. The latter type has a sufficient strength to permit it to take various attitudes, but the said latter type of doll is too expensive. Therefore, it costs too much to get an enough set of various kinds of dolls to satisfy children and, accordingly, quite undesirable from an educational point of view, the state being far from satisfiable.

The exchangeable-dressing doll according to the present invention is provided inside the body with freely flexible wires which permit the doll to take optional attitudes. Further, according to the present invention, since a soft and flexible foam sheet of thermoplastic synthetic resin is packed in the said body in such a manner that the said foam sheets forms a weld layer at the contour of the said body along therewith, the body is made totally in a swellingly protuberant form and the said weld layer constitutes a further solid contour as compared with those in the prior art.

Accordingly, an object of the present invention is to provide an exchangeable-dressing doll which can be manufactured inexpensively, in which the body can flex at optional parts such as limb, neck and trunk so that the doll can freely take fitting attitudes to the various attitudes.

A further object of the present invention is to provide an exchangeable-dressing doll which can be manufactured readily and used safely as a toy for children, in which the body of the said doll has some degree of stereoscopic appearance and reality as well as a soft and smooth touch.

Another object of the present invention is to provide a exchangeable-dressing doll having a sufficient toughness to stand violent and repeated uses by children, in which the clothes can be exchanged readily.

Still another object of the present invention is to provide an exchangeable-dressing doll which permits children to fully enjoy the modeling of his own dream and imagination and in which a remarkably wide range of exchangeable can be optionally put on the body of the said doll.

DETAILED DESCRIPTION OF INVENTION

Figure 1:
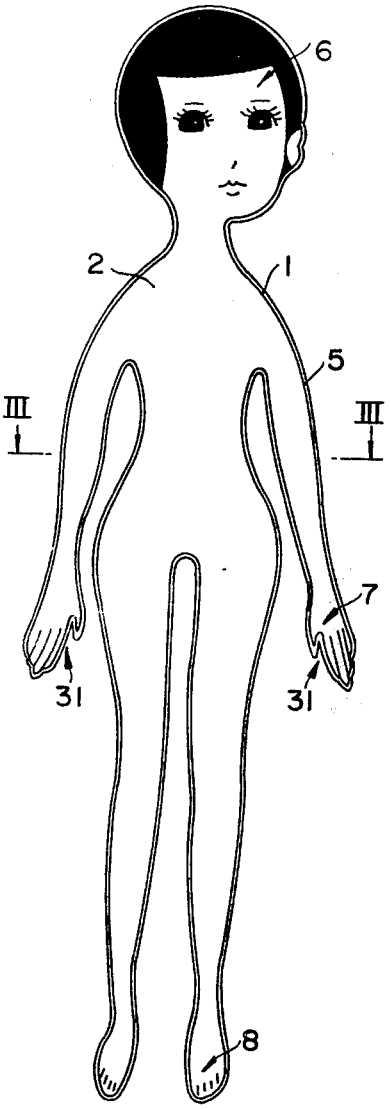
FIG. 1 is a front view of the body of the exchangeable-dressing doll according to the present invention.
Figure 2:
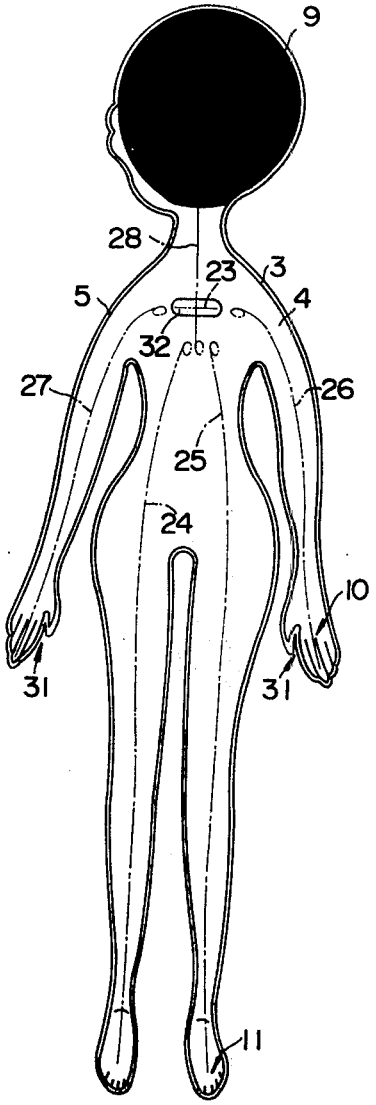
FIG. 2 is a rear view of the said body.

As shown in FIG. 1, the body of the doll according to the present invention has its front sheet 2 of flexible thermoplastic synthetic resin such as soft polyvinyl chrolide sheet having a contour 1 similar to the front contour of the whole human body and its rear sheet 4 of the same material as the said front sheet having a contour completely symmetric to the said contour 1 welded along the overall contour line 5 thereof to form an integral body.

The pattern 6 of the head and the pattern 6 of the front side of the head such as eyes, ears, mouth and the like are printed on the portion of the said front sheet 2 corresponding to the position of the head. Patterns of fingers of hands and feet 7 and 8 are also printed on the said front sheet. Similarly, the pattern of the back of the head 9 and patterns 10 and 11 of fingers of hands and feet are printed on the said rear sheet 4.

Thus, since the patterns of the body of the doll according to the present invention are made all in printed forms, dolls having either a male or female appearances can be manufactured both quite readily by changing the pattern of the front side of the doll's head.

Figure 3:
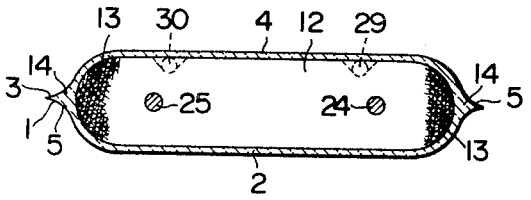
FIG. 3 is a enlarged cross section of the trunk of the said body cut along the line III — III in FIG. 1.
Figure 4:
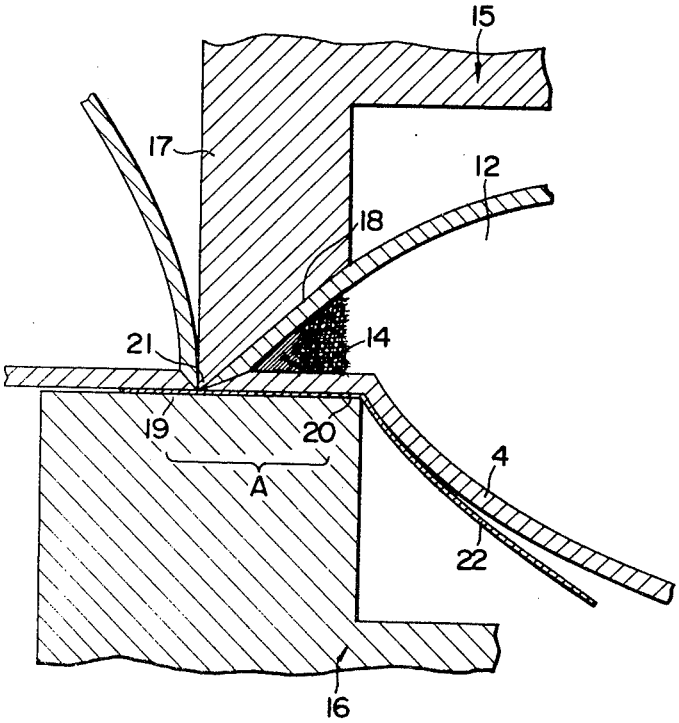
FIG. 4 is a section showing major parts of the manufacturing process of the said body.

As shown in FIG. 3, soft and flexible 12 of thermoplastic synthetic resin are packed in-between the said front sheet 2 and rear sheet 4, the whole outer peripheral portion 13 of the said foam sheet 12 forming a weld layer 14 together with the whole contour portions 1 and 3 of the said back and rear sheets 2 and 4 and with the inner peripheral portion adjacent thereto.

The said weld layer 14 is formed by the action of compression exerted by metallic molds comprising an upper mold 15 and a lower mold 16 and by high frequency dielectric heating.

That is to say, the said upper mold 15 is formed with a chain of fusing knife 17 in coincidence with the contour 1 of the front sheet 2 in such a manner that the knife edge face 18 thereof is inclined from the inside of the pattern toward the tip thereof. While, the lower mold 16 is formed with a flat knife 19 in coincidence with the said fusing knife 17 in such a manner that the inner edge 20 thereof is placed at a position displaced by a width of A from the knife edge 21 of the knife edge face 18 toward the inside of the pattern. In this case, a mold releasing paper is stuck on the upper face of the said flat knife 19 beforehand.

The rear sheet 4 is placed on the said lower mold 16 upside down by coinciding the flat knife 19 with the position of the pattern and, then, the foam sheet 12 is placed on the said rear sheet. Further, the front sheet 2 is placed thereon upward by coinciding the position of the pattern with the flat knife 19. Then, the upper mold 15 is lowered in coincidence with the position of the pattern. The respective sheets thus overlapped are compressed together and heated simultaneously by high frequency dielectric heating through the upper and lower molds used as the electrodes therefor.

As the knife edge 21 of the fusing knife 17 fuses the respective sheets 22 to reach the mold releasing paper, the front and the rear sheets 2, 4 and the foam sheet 12 are fused along the contours 1 and 3 and those portions of the front and rear sheets 2, 4 and the foam sheet squeezed between the inclined knife edge face 18 and the flat knife 19 corresponding to the length of the said width A are melted and welded together to form an integral weld layer 14 in the vicinity of the knife edge 21.

After cutting off the current through the upper and lower molds, the molds are cooled and released to obtain the doll having a construction as shown in the drawings.

The sticked portion of the doll thus formed through the weld layer has an extremely high exfoliation strength that prevents the doll from being damaged even by any violent handling. Further, the doll thus formed is provided with a sufficient buoyancy so that the doll does not sink under the water surface, even when used in bathing.

A cutout 23 is provided on the back, for example of the doll thus formed through the above-mentioned process and wires 24 and 25 such as resin coated copper or iron wires are penetrated from the said cutout through the layer of the said foam sheet 12 to the tips of the feet, preferably to the finger tips. Similarly, wires 26 and 27 are inserted in the body from the shoulders to the tips of the hands, preferably to the finger tips of the hands. In the preferred embodiment as shown in the drawings, a wire 28 is inserted in the body to reach the vertex through the neck.

After inserting the said respective wires in the body, a small piece 32 functioning also as a name plate is attached on the said cutout 23 to seal the said cutout, thus completing the doll according to the present invention.

The respective wire are inserted from the shoulder back portion of the body in the preferred embodiment as shown in the drawings. However, it should be noted that the location of the said cutout is not limited to the shoulder back portion.

Also as to the position along which wires are penetrated, wires may be inserted between the rear sheet 4 and the foam sheet 12 as indicated by the chain lines 29 and 30 in FIG. 3, without penetrating the layer of the foam sheet 12.

By the action of the freely flexible wires thus inserted, optional parts of the doll, such as the limb, neck, trunk and like are permited to flex freely and to hold the attitude then taken. Therefore, children can enjoy the play by causing the doll to take various attitudes freely fitting to the respective corresponding behaviors of a person and maintaining the attitudes thus taken for a time, or by returning the doll to the original attitude thereof, thus repeating the flexing actions.

Further, since the doll according to the present invention is made of soft and flexible synthetic resin, children can change even a rather tight dress surely and readily by freely flexing various parts of the doll without damaging the doll and even those exchangeable parts which are put on from above and not having an opened edge of joint type can be exchanged freely.

Further, since the body of the doll is provided with cuts between the respective hand fingers, various accessories such as handy bag, ornaments and the like are optionally put and held between the fingers and children can enjoy a doll remarkably abundant in the reality.

Figure 5:
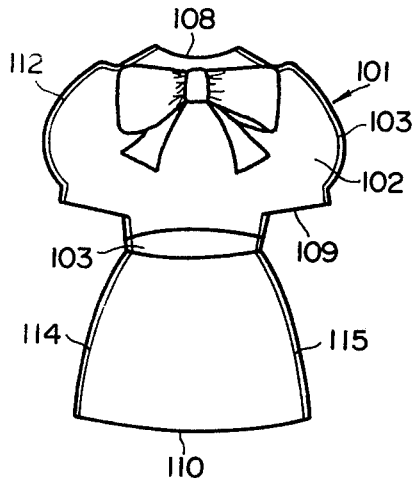
FIG. 5 is a front view of a preferred embodiment of the dress constituting one of exchangeable parts according to the present invention.
Figure 6:
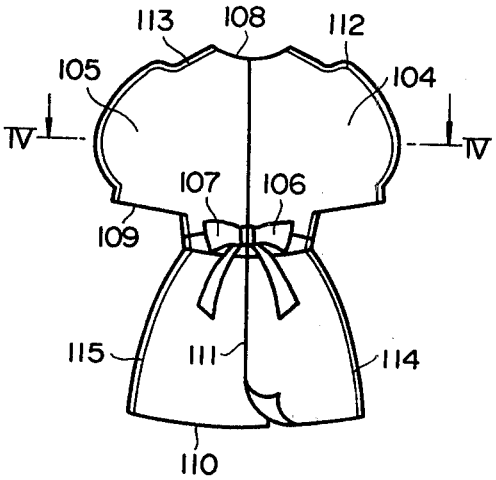
FIG. 6 is a rear view of the said dress.

FIG. 5 is a front view showing a preferred embodiment of a dress 101 constituting one of the exchangeable parts, such as clothes, shoes, gloves, hats and the like. FIG. 6 being a rear view thereof. Optional colour and design 103 are printed or dyed on the external surface of the front sheet comprising a flexible sheet of soft polyvinyl chloride, cloth, paper or the like. Similarly, optional colour and designs 106, 107 are printed or dyed on the external surfaces of the right back sheet 104 and the left back sheet 105 each comprising a soft sheet of the same quality as the front sheet.

The said front sheet 102 and the said right and left back sheets 104, 105 are stuck together at the contour portions 112, 113, 114 and 115, excepting the neck cutout 108, sleeve band 109, skirt 110 and back joint portion 111 of the rear body respectively constituting an opened edge for changing clothes.

In the preferred embodiment as shown in the drawings, the back joint portion 111 is constructed a butt joint between the right and left sheets 104 and 105 ranging from the neck cutout 108 to the skirt 110. However, the present invention is not limited to such a construction.

If thermoplastic synthetic resin sheets such as soft polyvinyl chloride sheets are used, the said contour portions 112, 113, 114 and 115 can be welded integrally and, therefore, products having remarkably high exfoliation strength at the contour portions can be produced.

Figure 7:
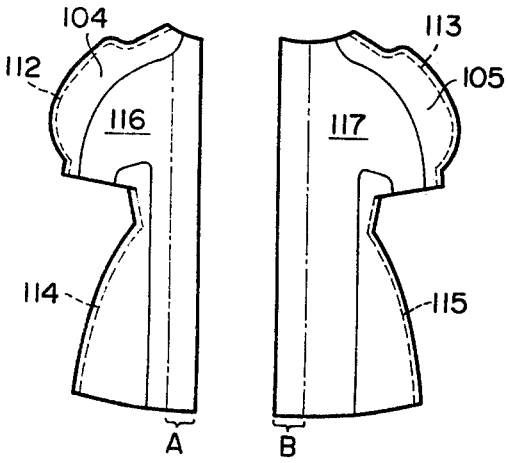
FIG. 7 is a broken-down illustration showing the back of the rear body sheet.
Figure 8:
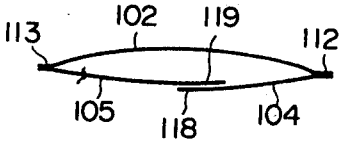
FIG. 8 is a section cut along the line IV — IV in FIG. 6.

As shown in FIG. 7, coating zones 116 and 117 of organic solvent of the same quality as that mixed in the printing ink used to print the said colour and design are formed on the back of the said right and left rear sheets 104, 105, excepting those portions corresponding to the contour portions 112, 113, 114 and 115 to be welded. The said coating zones have a function to prevent the front and rear sheet from tending to be turned up toward the printing side, as usual in the prior art, along with the evaporation and drying of organic solvent contained in the printing ink applied on the external surface. This is resulted from the provision of zones coated by organic solvent of the same quality as that used in the printing ink or coating agent containing the said organic solvent as the main component thereof on the back of portions at least in the vicinity of the opened edge portions for the cloth exchanging. That is to say, the action of the said portions to bend and turn up backward is balanced and cancelled out with the action of the said printing ink tending to bend and turn up the said portions toward the printing surface. As the result, the said portions in the vicinity of the said opened edges including the edges 118, 119 of the back joint portion 111 are prevented from being turned up and located substantially in the same plane as the right and left rear sheets 104 and 105.

Accordingly, the said dress according to the present invention looks neat and does not cause any unexpected separation, thus further improving children's interest in the doll.

Also, the said coated zones 116, 117 may be provided on the front sheet so that the whole exchangeable parts may be held always in rather flat shapes. When the said contour portions are to be welded immediately after the formation of the said coated portions, the latters should be formed by avoiding the said contour portions.

The coating agent to be applied on the said coated zones 116, 117 may comprise the said organic solvent, or other coating agent to which any appropriate additives such as pigments are added may be used.

It is preferable that the said coated zones 116, 117 include the cutout edges of opened edge portions such as the said neck cutout 108, sleeve band 109, skirt and back joint portion of the rear body and the vicinity thereof. However, in relatively narrower portions such as neck cutout 108 and sleeve band 109, that is to say, if the interval between the welds at the ends of such a coated zone, the said coated zone may be located at any appropriate positions spaced apart from the said vicinity of the opened edge portions.

Further, if any complicated shapes are contained, the said coated zones may be provided only at those positions close to the end edges of the opened edge portions, as indicated by the signs A and B in FIG. 7.

Hereinbefore, we have described one preferred embodiment of the exchangeable parts according to the present invention in terms of a dress. However, it should be noted that the exchangeable parts according to the present invention may comprise any appropriate parts including hats, wigs, shoes, shawls and the like, not limiting only to dresses.

Figure 9:
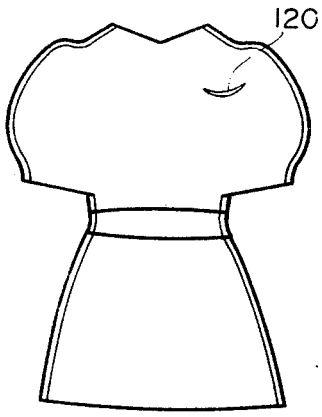
FIG. 9 is a front view of another embodiment of the dress constituting one of exchangeable parts.
Figure 10:
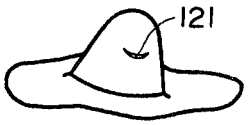
FIG. 10 is a front view of the hat constituting one of exchangeable parts.
Figure 11:
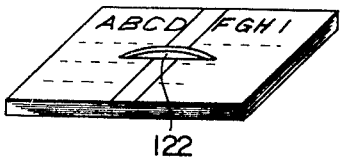
FIG. 11 is an oblique view showing the back of the book constituting one of exchangeable parts.

In a dress as shown in FIG. 9, a cutout 120 is provided for permitting the insertion of accessories such as a brooch or an artificial flower for an ornamental purpose. In FIG. 10, a cutout 120 provided on the side of the hat permits to put on accessories for the hat such as a feather or an artificial flower. The book shown in FIG. 11 is provided at its central portion a cutout 121 for the insertion of hand fingers of the doll body, thereby permitting the child to enjoy various reading attitudes of doll by fitting the said cutout to the hand fingers of the doll.

As fully described hereinbefore, it will be understood that children can fully satisfy their own creative will by freely using the said various exchangeable parts and, thus, the exchangeable-dressing doll according to the present invention can be highly effective educational also from the view point of the culture of sentiments.

What I claim is:

1. An exchangeable-dressing doll comprising:

a body of the said exchangeable-dressing doll characterized in that a front sheet of flexible thermoplastic synthetic resin having a contour simulated to the front contour of the whole human body and a rear sheet of the same quality as the said front sheet having a contour symmetric thereto are welded together along the whole contour line, a flexible foam sheet of thermoplastic synthetic resin packed in and between the said two sheets, the peripheral portions of the foam sheet adjacent to the weld forming a weld layer together with the whole peripheral portions of the contours of the said front and rear sheets and with the inner peripheral portions adjacent thereto, wires free to flex being inserted in and between at least those portions of the said two sheets which correspond to the limbs of the said doll, and that the pattern of the front side of the head part including the face is printed at least on that portion of the said front sheet corresponding to the head of the doll, while the pattern of the rear side of the head part is printed at least on that portion of the said rear sheet corresponding to the head of the said doll, and freely detachable exchangeable-dressing parts for the said exchangeable-dressing doll including clothes, shoes, gloves, hats, wigs and the like and being so formed that front and rear flexible sheets with colors, designs, etc. dyed or printed on their external surfaces are integrally stuck at contour portions except opening portions for the dress exchanging.

2. An exchangeable-dressing doll according to the claim 1, wherein cutouts are provided between hand fingers of the said doll so that the body of the said doll can hold a handy bag and other accessories by utilizing the said cutouts.

3. An exchangeable-dressing doll according to the claim 1, wherein accessories and other exchangeable parts are provided with a cutout for the insertion of hand fingers of the said doll body.

4. An exchangeable-dressing doll according to the claim 1, wherein the said exchangeable parts are made of cloth or paper.

5. An exchangeable-dressing doll according to the claim 1, wherein the said exchangeable parts are made of thermoplastic synthetic resin.

6. An exchangeable-dressing doll according to the claim 1, wherein the said exchangeable parts are provided with a cutout for the insertion of accessories.

7. An exchangeable-dressing doll according to the claim 5, wherein stuck contour portions of the said exchangeable parts are welded.

8. An exchangeable-dressing doll according to the claim 5, wherein coated zones coated with an organic solvent of the same quality as that of the ink used in the said printing or other coating agents containing the said organic solvent as the main component thereof are formed on the backs of at least those portions of the said exchangeable parts in the vicinity of the said opened cutout edge portions.

* * * * *